US007464790B2

(12) United States Patent
Kodama et al.

(10) Patent No.: US 7,464,790 B2
(45) Date of Patent: Dec. 16, 2008

(54) SOUND INSULATION/ABSORPTION STRUCTURE, AND STRUCTURE HAVING THESE APPLIED THERETO

(75) Inventors: Hidekazu Kodama, Tokyo (JP); Munehiro Date, Tokyo (JP); Pavel Mokry, Tokyo (JP); Kazunori Kimura, Tokyo (JP); Tomonao Okubo, Tokyo (JP); Eiichi Fukada, Tokyo (JP)

(73) Assignees: Rion Co., Ltd, Tokyo (JP); Kobayashi Institute of Physical Research, Tokyo (JP)

( * ) Notice: Subject to any disclaimer, the term of this patent is extended or adjusted under 35 U.S.C. 154(b) by 553 days.

(21) Appl. No.: 10/562,924

(22) PCT Filed: May 27, 2004

(86) PCT No.: PCT/JP2004/007639

§ 371 (c)(1),
(2), (4) Date: Dec. 27, 2005

(87) PCT Pub. No.: WO2004/107313

PCT Pub. Date: Dec. 9, 2004

(65) Prior Publication Data

US 2006/0152108 A1 Jul. 13, 2006

(30) Foreign Application Priority Data

May 29, 2003 (JP) ..... 2003-151871

(51) Int. Cl.
*E04B 1/82* (2006.01)

(52) U.S. Cl. ..... 181/295; 181/286; 181/290

(58) Field of Classification Search ..... 181/295, 181/290, 286
See application file for complete search history.

(56) References Cited

U.S. PATENT DOCUMENTS 3,215,225 A * 11/1965 Kirschner ..... 181/290

(Continued)

FOREIGN PATENT DOCUMENTS

JP 05-094195 A 4/1993

(Continued)

*Primary Examiner*—Walter Benson
*Assistant Examiner*—Christina Russell
(74) *Attorney, Agent, or Firm*—Carrier, Blackman & Associates, P.C.; Joseph P. Carrier; William D. Blackman

(57) ABSTRACT

A sound insulation/absorption structure, a sound insulation/absorption device, and a structure having these applied thereto and a member constituting the same, are capable of insulating or absorbing sound by stiffness control. The sound insulation/absorption structure comprises a film member, such as a polymer film or metal foil, and a frame body having at least one annular opening, the film member being fixed to the frame body, the section of the film member surrounded by the frame body being of a curved shape such as a dome, wherein the resonance frequency of the in-plane stretching of this curved shape is set at a frequency equal to or higher than the audible frequency band, so as to insulate or absorb sound by the elastic force of the film. The film member may be replaced by an acrylic, polyethylene terephthalate or other plastic plate, an aluminum or other metal plate, or a veneer or other plate member, molded into a curved shape, such as a dome, a semi-cylinder and a cone.

20 Claims, 7 Drawing Sheets

(a)

(b)

U.S. PATENT DOCUMENTS

| | | | | | |
|---|---|---|---|---|---|
| 3,399,103 | A * | 8/1968 | Salyer et al. | 428/116 |
| 3,649,430 | A * | 3/1972 | Lewis et al. | 428/138 |
| 3,887,031 | A * | 6/1975 | Wirt | 181/286 |
| 4,228,869 | A * | 10/1980 | Bschorr | 181/286 |
| 4,355,064 | A * | 10/1982 | Imhof | 428/178 |
| 4,570,748 | A * | 2/1986 | Ghibu et al. | 181/286 |
| 4,683,979 | A * | 8/1987 | Ghibu et al. | 181/286 |
| 4,753,841 | A * | 6/1988 | Noel et al. | 428/174 |
| 5,521,341 | A * | 5/1996 | Stief et al. | 181/295 |
| 6,075,308 | A * | 6/2000 | Date | 310/314 |
| 6,173,806 | B1 * | 1/2001 | Ito | 181/210 |
| 6,617,002 | B2 * | 9/2003 | Wood | 428/131 |
| 7,178,630 | B1 * | 2/2007 | Perdue | 181/290 |
| 2001/0050197 | A1 * | 12/2001 | Wood | 181/292 |
| 2005/0000751 | A1 * | 1/2005 | Sheng et al. | 181/290 |
| 2006/0008099 | A1 * | 1/2006 | Azima et al. | 381/191 |

FOREIGN PATENT DOCUMENTS

| | | | |
|---|---|---|---|
| JP | 06-161463 | A | 6/1994 |
| JP | 10-205173 | | 8/1998 |
| JP | 10-268874 | A | 10/1998 |
| JP | 2003-166298 | A | 6/2003 |

* cited by examiner

PRIOR ART

SOUND INSULATION/ABSORPTION STRUCTURE, AND STRUCTURE HAVING THESE APPLIED THERETO

CROSS-REFERENCE TO RELATED APPLICATIONS

The present invention is the US National Phase of International Application PCT/JP2004/007639, filed 27 May 2004, which claims priority under 35 USC 119 based on Japanese patent application No. 2003-151871, filed 29 May 2003. The entire contents of the International and priority Japanese applications are incorporated herein by reference.

BACKGROUND OF THE INVENTION

1. Field of the Invention

The present invention relates to a sound insulation/absorption structure, a sound insulation/absorption device, and a structure having these applied thereto and a member constituting the same, which insulate sound by elastic repulsion or absorb the sound by an elastic loss.

2. Description of the Prior Art

The sound insulation performance of a single layer wall improves in proportion to the increasing amount of mass. Thus, a material with large mass, such as a concrete wall, a block wall, a bonded brick wall, lead, and a steel plate, is used to insulate a sound. A sound transmission loss is used as an index to show the sound insulation performance of a wall. The sound transmission loss TL of the single layer wall in the case where the sound is vertically incident on the wall surface is expressed by the following formula (1):

$$TL = 10\log_{10}\left[\left(\frac{r}{2\rho_0 c_0}+1\right)^2+\left(\frac{\omega m - Y/\omega}{2\rho_0 c_0}\right)^2\right] \quad (1)$$

where $\omega$ is an angular frequency, $\rho_0$ is the density of air, $c_0$ is the sound velocity of air, r is the viscous resistance of the wall in the thickness direction, m is the mass of the wall, and y is the elastic constant of the wall in the thickness direction.

FIG. 16 shows the sound transmission loss TL obtained by the formula (1) relative the thickness direction shown in the following formula (2):

$$f_r = \frac{1}{2\pi}\sqrt{\frac{Y}{m}} \quad (2)$$

The sound transmission loss TL is proportional to the frequency in 6 dB/oct on the higher frequency side than the resonance frequency fr. This area results from a term including the mass of the formula (1) and is referred to as a mass law.

On the other hand, the sound transmission loss TL is inversely proportional to the frequency in −6 dB/oct on the lower frequency side than the resonance frequency fr. This area results from a term including an elastic constant of the formula (1) and is generally referred to as stiffness control.

In a conventional technique, the resonance frequency fr is provided in a low frequency area. Since the sound insulation performance of a sound insulation wall in an audible area depends on the mass law, the sound insulation performance of the wall deteriorates in proportion to low frequency sound. The sound insulation performance can be improved by increasing the thickness (a surface density), but the increase of the sound transmission loss is 6 dB at most even by doubling the thickness. It is also said that a film or plate with a small surface density hardly ever has the sound insulation performance. On the other hand, a sound of a lower frequency than the resonance frequency fr can be insulated in theory by the action of the wall elasticity.

Thus, problems are pointed out in the conventional sound insulation method whereby the sound insulation performance deteriorates in proportion to low frequency sound and there is a limit to the necessary steps which can be taken to improve the sound insulation especially in collective housing or transport facilities because the sound insulation performance depends in collective housing or transport facilities because the sound insulation performance depends on the surface density.

Since the sound insulation method using stiffness control does not depend on the mass, it is not only possible to take proper sound insulation steps at the places where sound insulation steps could not be taken in the past, but also sound insulation for the low frequency sound can be expected. However, a sound insulation/absorption structure using stiffness control has not been in practical use as yet.

As a sound insulation/absorption structure for bringing stiffness control into view, a sound insulation structure and a sound insulation/absorption complex structure are known, which comprise a frame body, surface materials provided on both sides of the frame body, and a sound absorption material filled within these surface materials, wherein each surface material is formed to have a curved surface shape to increase the stiffness (rigidity) so that the stiffness area in the transmission loss frequency characteristics reaches a frequency higher than the resonance transmission frequency determined by the surface density of the surface material and the spacing of the surface materials (e.g., refer to Japanese Patent Application Publication No. 5-94195).

Further, a sound insulation structure is known, which comprises a frame body, surface materials provided on both sides of the frame body, and a sound absorption material filled between these surface materials, wherein the surface materials are curved to increase the stiffness (rigidity) by pressurizing or depressurizing a space surrounded by the frame body and the surface materials. Sound insulation loss (deficiency) by the resonance transmission is prevented by controlling the vibrations of the surface materials (e.g., refer to Japanese Patent Application Publication No. 6-161463).

A variable sound absorption device is also known, which comprises a piezoelectric material having piezoelectric properties of which the outer periphery is secured, a pair of electrodes provided on both opposite faces of this piezoelectric material, and a negative capacitance circuit adapted to connect between these electrodes, wherein the piezoelectric material is in a curved flat state and the electric properties of the negative capacitance circuit is constituted to be variable, thereby changing an elastic constant and a loss factor of the piezoelectric material (e.g., refer to Japanese Patent Application Publication No. 11-161284).

However, the inventions disclosed in Japanese Patent Application Publication Nos. 5-94195 and 6-161463 refer to a technique to control deformation from a surface friction, in other words, a sound transmission caused by a bending resonance of a sound insulation wall as a result of increasing stiffness, a so-called coincidence, wherein the resonance frequency of this bending is due to the surface friction seen in a mass control domain in addition to the resonance frequency fr in the thickness direction as described above. Accordingly, to attain sound insulation by stiffness control, it is necessary to discuss the resonance frequency fr, that is, the surface density and the elasticity of the in-plane stretching. However, these inventions do not deal with the resonance frequency fr and thus, our problems can not be solved.

Further, the invention disclosed in Japanese Patent Application Publication No. 11-161284 describes in theory that if the film is curved, the attenuation of sound can be increased. However, this invention does not describe that the sound insulation by elastic repulsion (stiffness control) of the film can be attained in less than the resonance frequency f r and the sound insulation performance depends on the mass of the film, the length of the periphery, the elastic constant, and the tensile force. The invention does not describe a sound insulation/absorption structure taking these into consideration. Thus, our problems cannot be solved.

SUMMARY OF THE INVENTION

It is therefore an object of the present invention to overcome the above-mentioned problems in the conventional technology and to provide a sound insulation/absorption structure, a sound insulation/absorption device, and a structure having these applied thereto and a member constituting the same.

To overcome the above-mentioned problems, according to a first aspect of the invention, a film member such as a polymer film and a metal foil is formed into a curved shape such as a dome, a barrel, and a cone, the periphery of this curved shape is fixed to another structure, and the resonance frequency of the curved shape in the in-plane stretching is set at a frequency equal to or higher than the audible frequency band to insulate or absorb sound by the elastic force of the film member.

By securing the film member directly to the structure, it is possible to insulate or absorb the sound by stiffness control.

The invention according to a second aspect thereof comprises a film member, such as a polymer film and a metal foil, and a frame body having at least one opening of a lattice shape, a honeycomb shape or an annular shape, wherein the film member is fixed to the frame body, the section of the film member surrounded by the frame body is formed into a curved shape such as a dome, a barrel, and a cone, and the resonance frequency of the curved shape in the in-plane stretching is set at a frequency equal to or higher than the audible frequency band, thereby insulating or absorbing sound by the elastic force of the film member.

In this manner, the invention comprises the light film member and the frame body having at least one opening of a lattice, honeycomb or annular shape, wherein the periphery of the film member is secured by the frame body, the section of the film member surrounded by the frame body is formed into a curved shape such as a dome and a barrel, and the resonance frequency of the section in the in-plane stretching vibration is set at a frequency equal to or higher than the audible frequency band, thereby being capable of insulating or absorbing sound by stiffness control.

The invention according to a third aspect thereof refers to a sound insulation/absorption structure according to either of the first or second aspect in which a holding means is provided to hold the film member in the curved shape.

In this manner, the tensile force and the curved shape such as a dome can be applied to the film member by the holding means for holding and thus, sound insulation or absorption by stiffness control can be conducted.

The invention according to a fourth aspect thereof refers to the sound insulation/absorption structure according to either of the first or second aspect in which the tensile force is applied to the film member.

By applying the tensile force to the film member, it is possible to effectively insulate or absorb sound by stiffness control.

The invention according to a fifth aspect thereof refers to the sound insulation/absorption structure according to either of the first or second aspect in which the film member is replaced by a plate member, such as a plastic plate, a metal plate and a veneer board (plate), formed into the curved shape such as a dome, a barrel and a cone.

In this manner, the sound insulation/absorption structure comprises a light plate member, and a frame body having at least one opening of a lattice, honeycomb or annular shape, wherein the periphery of the plate member is secured by the frame body, the section of the plate member surrounded by the frame body is formed into a curved shape such as a dome and a barrel, the resonance frequency of the section in the in-plane stretching vibration is set at a frequency equal to or higher than the audible frequency band, thereby being capable of insulating or absorbing sound by stiffness control.

The invention according to a sixth aspect thereof comprises a film member, a frame body, an elastic body, and a supporting plate, wherein the elastic body and the film member are placed on the supporting plate to be pressed with the frame body so that the elastic body and the film member are held between the frame body and the supporting plate to apply a tensile force to the film member, the film member is formed into a curved shape such as a dome, and the resonance frequency of the curved shape in the in-plane stretching is set at a frequency equal to or higher than the audible frequency band to insulate or absorb sound by the elastic force of the film member.

As described above, the elastic body and the film member are placed on the supporting plate to be pressed with the frame body so that the elastic body and the film member are held between the frame body and the supporting plate to apply the tensile force to the film member, the film member is formed into the curved shape such as a dome, and the resonance frequency of the curvature-having shape in the in-plane stretching is set at a frequency equal to or higher than the audible frequency band, thereby being capable of insulating or absorbing sound by stiffness control.

The invention according to a seventh aspect thereof comprises two film members, a frame body, and an elastic body, wherein the elastic body is placed between the two film members, the elastic body and the two film members are held between the frame body to apply a tensile force to the two film members, the two film members are formed into a curved shape such as a dome, and the resonance frequency of the curved shape in the in-plane stretching is set at a frequency equal to or higher than the audible frequency band to insulate or absorb sound by the elastic force of the film members.

In this manner, the elastic body is placed between the two film members, the elastic body and the two film members are further held between the frame body to apply the tensile force to the two film members, the two film members are formed into the curved shape such as a dome, and the resonance frequency of the curved shape in the in-plane stretching is set at a frequency equal to or higher than the audible frequency band, thereby being capable of insulating or absorbing sound by stiffness control.

The invention according to according to an eighth aspect thereof refers to the sound insulation/absorption structure of any of the first-seventh aspects, wherein the film member formed into the curved shape or the plate member formed into the curved shape is set in a one- or two-dimensional array.

With this arrangement, by setting the film member(s) formed into the curved shape or the plate member formed into the curved shape in a one or two-dimensional array, it is possible to form a sound insulation/absorption structure which extensively insulates or absorbs sound by stiffness control.

The invention according to according to an ninth aspect thereof refers to the sound insulation/absorption structure of any of the first-eighth aspects, wherein the surface density, elastic constant, outer peripheral dimensions, and curvature radius of the curved section of the film member(s) or the plate member are set so that the resonance frequency in the in-plane stretching vibration is within or higher than the audible frequency band.

The invention according to according to an tenth aspect thereof refers to the sound insulation/absorption structure of any of the first-ninth aspects, wherein the film member(s) or the plate member and the frame body securing these are integrally formed.

In the invention according to an eleventh aspect thereof, the film member(s) or the plate member constituting the sound insulation/absorption structure according to any of the first-tenth aspects is provided with a piezoelectric member to which a circuit presenting a negative capacitance is connected.

By connecting the circuit presenting the negative capacitance to the piezoelectric member attached to the film member(s) or the plate member, it is possible to constitute a sound insulation/absorption device which can electrically control the sound insulation/absorption performance.

In the invention according to an twelfth aspect thereof, the film member or the plate member constituting the sound insulation/absorption structure according to any of the first-tenth aspects is a member with piezoelectric properties to which a circuit presenting a negative capacitance is connected.

By connecting the circuit presenting the negative capacitance to the film member(s) or the plate member having the piezoelectric properties, it is possible to constitute a sound insulation/absorption device which can electrically control the sound insulation/absorption performance.

In the invention according to an thirteenth aspect thereof, the sound insulation/absorption structure according to any of the first-tenth aspects is applied to structures such as an automobile, a vehicle such as an electric train, an aircraft, a marine vessel and other transport equipment (vehicle), a panel, partition and other building material, a sound insulation wall, a sound-proof wall, a building structure, a chamber, electric equipment, a machine, acoustic equipment and the like to insulate or absorb sound.

In the invention according to an fourteenth aspect thereof, the sound insulation/absorption structure according to any of the first-tenth aspects is applied to a member constituting the structures such as an automobile, a vehicle such as an electric train, an aircraft, a marine vessel and other transport equipment (vehicle), a panel, a partition and other building material, a sound insulation wall, a sound-proof wall, a building structure, a chamber, electric equipment, a machine, acoustic equipment and the like to insulate or absorb sound.

In the invention according to an fifteenth aspect thereof, the sound insulation/absorption device according to either the eleventh or twelfth aspect is applied to structures such as an automobile, a vehicle such as an electric train, an aircraft, a marine vessel and other transport equipment (vehicle), a panel, a partition and other building material, a sound insulation wall, a sound-proof wall, a building structure, a chamber, electric equipment, a machine, acoustic equipment and the like to insulate or absorb sound.

In the invention according to an sixteenth aspect thereof, the sound insulation/absorption device according to either the eleventh or twelfth aspect is applied to a member constituting the structures such as an automobile, a vehicle such as an electric train, an aircraft, a marine vessel and other transport equipment (vehicle), a panel, a partition and other building material, a sound insulation wall, a sound-proof wall, a building structure, a chamber, electric equipment, a machine, acoustic equipment and the like to insulate or absorb sound.

BRIEF DESCRIPTION THE DRAWINGS

DETAILED DESCRIPTION OF THE PREFERRED EMBODIMENTS

Figure 1:
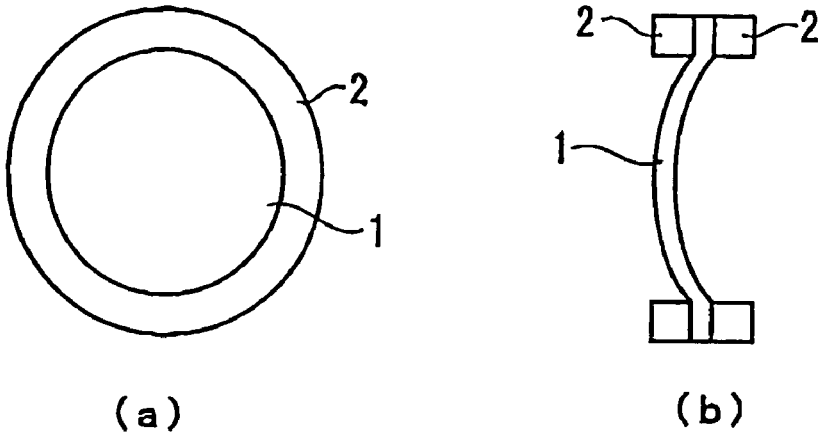
FIG. 1 shows a first embodiment of a sound insulation/absorption structure according to the present invention, wherein FIGS. 1 (*a*) and 1 (*b*) are the front view and the cross-sectional view thereof, respectively.

The preferred embodiments of the present invention will be described hereunder with reference to the accompanying drawings (FIGS. 1 through 15).

A sound insulation/absorption structure according to the present invention comprises a light film or plate member, formed into a curved shape such as a dome and a barrel, which has been considered to have a lesser sound insulation performance in the past, and a frame body adapted to secure its periphery. The film or plate member has less strain by sound pressure in a flat shape and has little sound insulation performance by elasticity and little sound absorption performance by an elastic loss.

However, when the film or plate member is formed into a curved shape such as a dome and a barrel, it begins to produce the in-plane stretching vibration increasing or decreasing the curvature by sound pressure. By causing the film or plate member to produce the in-plane stretching vibration by sound pressure, sound insulation of the film or plate member by elasticity and sound absorption by elastic loss are possible.

Sound insulation by the film member formed into the dome shape or the like is attained at a lower frequency band than the resonance frequency fr of the in-plane stretching vibration. If the lighter film member with larger elastic constant is used according to the formula (2), it is possible to easily set the resonance frequency fr at a frequency higher than the audible frequency band. Since the resonance frequency fr depends on the curvature radius of the film, thickness of the film member, tensile force applied to the film member, and length of the section secured by the frame body, it is necessary to properly fix these to set the resonance frequency fr at the intended frequency.

A sound transmission loss TL and a sound absorption coefficient $\alpha$ of the film member of which the periphery is secured and to which a curvature has been applied is given by the following formulas (3) through (5):

$$TL = 10\log_{10}\left[1 + \frac{Y''}{\omega\zeta} + \frac{(Y'')^2 + (Y' - \rho\omega^2 R^2)^2}{(2\omega\zeta)^2}\right] \tag{3}$$

$$\alpha = \frac{4\zeta\omega Y''}{(Y' - \rho\omega^2 R^2)^2 + (Y'' + \omega\zeta)^2} \tag{4}$$

$$\zeta = \rho_0 c_0 R^2 / h \tag{5}$$

where Y' is the in-plane elastic constant of the film member, Y" is the in-plane elastic loss of the film member, $\omega$ is the angular frequency, $\rho$ is the density of the film member, h is the thickness of the film member, R is the curvature radius of the film member, $\rho_0$ is density of air, and $c_0$ is the sound velocity of air.

According to the formulas (3) through (5), the sound transmission loss TL and the sound absorption coefficient $\alpha$ become minimal when the film member is in a flat shape ($R=\infty$) and increase as R becomes smaller because the sound transmission loss TL and the sound absorption coefficient $\alpha$ are in inverse proportion to R.

The sound insulation/absorption structure according to the present invention provides an optimum structure, material and technique to embody the above-mentioned principle as a sound insulation structure which requires a large area and combines a frame body rigid relative to sound and a film or plate member provided with curvature. In the case where the frame body has a flat shape, flexure (deflection) may be caused in the frame body itself depending on the sound to decrease the sound insulation performance. By bending the frame body, the flexure of the frame body by the sound can be reduced so as to prevent the deterioration of the sound insulation performance.

As shown in FIG. 1, a first embodiment of a sound insulation/absorption structure according to the present invention comprises a film member 1 formed into a domed shape with a curvature and an annular frame body 2 adapted to secure the film member 1 by securing the edge section of the film member 1 between both sides of the frame body 2. A metal foil such as an aluminum foil, a polymer film such as a polyethylene film or the like is used as the film member 1. The shape of the film member 1 of which the edge section is secured by the frame body 2 can not only be a dome shape, but also a shape with curvature such as a barrel and a cone. On the other hand, the frame body 2 can not only be an annular shape, but also a square (lattice) shape, a hexagonal (honeycomb) shape and the like. The frame body 2 can be made of plastics, metal and the like.

The film member can be replaced by a plastic plate such as an acrylic and a polyethylene terephthalate, a metal plate such as aluminum or a plate member such as a veneer board, formed into a curved shape such as a dome, a barrel, and a cone.

Figure 2:
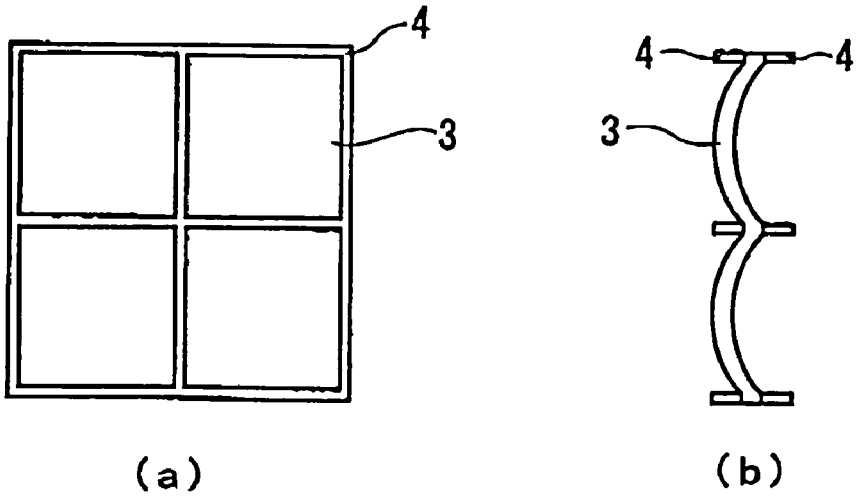
FIG. 2 shows a second embodiment of the sound insulation/absorption structure according to the present invention, wherein FIGS. 2 (*a*) and 2 (*b*) are the front view and the cross-sectional view thereof, respectively.

As shown in FIG. 2, a second embodiment of the sound insulation/absorption structure can also be composed of a film member 3 having a curved shape such as a dome formed at four places and a square-shaped (lattice-shaped) frame body 4 adapted to secure the film member 3 by holding the periphery of each curved shape between both sides thereof. It is to be noted that the number of curved shapes such as the dome formed on the film member 3 can not be limited to four, but a plurality of curved shapes can be provided. In this case, the frame body 4 can be formed to meet the number of curved shapes such as the dome formed on the film member 3.

Figure 3:
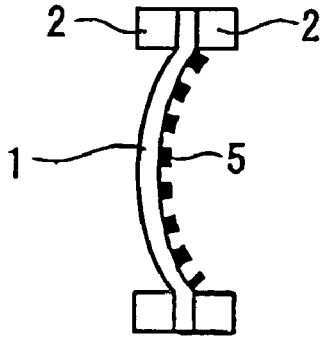
FIG. 3 is a cross-sectional view of a third embodiment of the sound insulation/absorption structure according to the present invention.

In a third embodiment of the sound insulation/absorption structure as shown in FIG. 3, a metal mesh 5 serving as a holding means is formed in a dome or barrel shape. The film member 1 held between both sides of the annular frame body 2 is applied to the metal mesh 5, wherein the tensile force and the curved shape such as the dome are applied to the film member 1.

Figure 4:
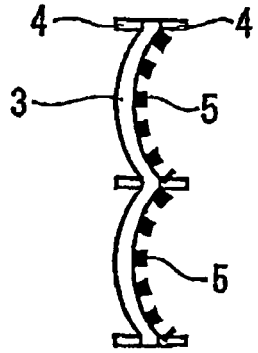
FIG. 4 is a cross-sectional view of a fourth embodiment of the sound insulation/absorption structure according to the present invention.

A fourth embodiment of the sound insulation/absorption structure as shown in FIG. 4 is provided, in which a plurality of metal meshes 5 is formed in a dome shape and a film member 3 held between both sides of a frame body 4 of a lattice shape is applied to the metal mesh 5 so that the tensile force and the curved shape such as the dome are applied to the film member 3.

Figure 5:
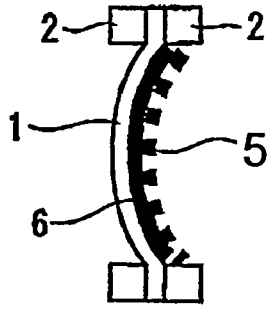
FIG. 5 is a cross-sectional view of a fifth embodiment of the sound insulation/absorption structure according to the present invention.

Referring to a fifth embodiment of the sound insulation/absorption structure as shown in FIG. 5, an elastic body 6 such as sponge serving as a protective layer is provided between the film member 1 and the metal mesh 5 in the third embodiment.

Figure 6:
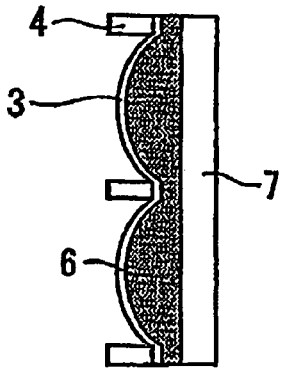
FIG. 6 is a cross-sectional view of a sixth embodiment of the sound insulation/absorption structure according to the present invention.

A sixth embodiment of the sound insulation/absorption structure is provided as shown in FIG. 6, in which an elastic body 6 and a film member 3 are put on a supporting plate 7 to be pressed by a lattice-shaped frame body 4 so that the elastic body 6 and the film member 3 are held between the frame body 4 and the supporting plate 7, wherein the tensile force is applied to the film member 3 formed into a curved shape such as a dome.

Figure 7:
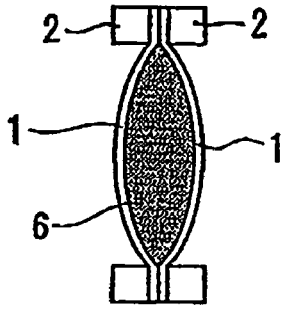
FIG. 7 is a cross-sectional view of a seventh embodiment of the sound insulation/absorption structure according to the present invention.

Referring to a seventh embodiment of the sound insulation/absorption structure as shown in FIG. 7, the elastic body 6 is held between two film members 1 and the elastic body 6 and the two film members 1 are then held between the frame body 2 to apply the tensile force to the two film members 1, wherein the two film members 1 are formed into a curved shape such as a dome.

In this case, a sound absorption effect can be added if a material with sound absorption power (a sound absorption material) such as glass wool and rock wool is used. The film member 1 can be replaced by a plate member such as a plastic plate, a metal plate and a veneer board, formed into a curved shape such as a dome and a barrel.

In any sound insulation/absorption structure as shown in FIGS. 1 through 7, the sound insulation performance and the sound absorption performance depend on the resonance frequency fr of the sections of the film members 1 and 3 surrounded by the frame bodies 2 and 4 in the in-plane stretching vibration. It is therefore important to set the surface density and elastic constant of the film members 1 and 3, and the length, curvature radius, and tensile force of the sections surrounded by the frame bodies 2 and 4 so that this resonance frequency is set at a frequency equal to or higher than the audible frequency band.

Further, if a material with piezoelectric properties (i.e., a piezoelectric body) is used as the film members 1 and 3 constituting the sound insulation/absorption structure, an electrode is provided on each side of the piezoelectric material, and an electric circuit presenting a negative capacitance (i.e., negative capacitance circuit) is connected in such an equivalent manner that a condenser having a negative capacitance is connected in parallel or in series, it is possible to constitute a sound insulation/absorption device which can artificially change the sound insulation performance and the sound absorption performance by electrically changing the elastic constant of the film members 1 and 3.

Available as the piezoelectric body is a piezoelectric polymer such as a polyvinylidene fluoride, a vinylidene fluoride copolymer, a polylactic acid, and cellulose; piezoelectric ceramics such as PZT; or a composite material of the piezoelectric material and the polymer material.

Figure 8:
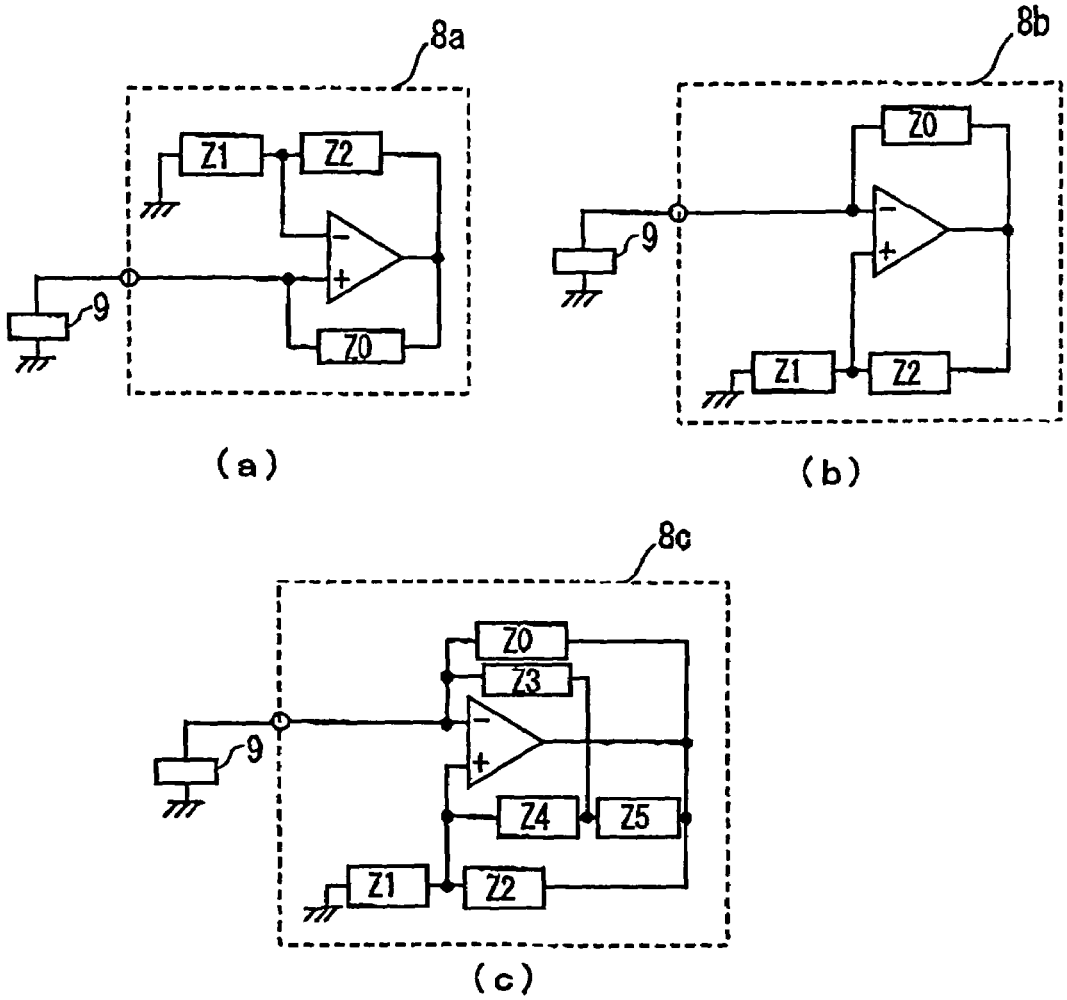
FIG. 8 shows a schematic diagram of an electric circuit presenting a negative capacitance, wherein FIG. 8 (*a*) shows the case where a piezoelectric body and the negative capacitance are connected in parallel and FIGS. 8 (*b*) and (*c*) show the cases where the piezoelectric body and the negative capacitance are series-connected.

FIG. 8 shows negative capacitance circuits 8*a*, 8*b* and 8*c*. In the negative capacitance circuit 8*a* as shown in FIG. 8(*a*), the elastic constant of the piezoelectric body 9 can be increased, while in the negative capacitance circuits 8*b* and 8*c* as shown in FIGS. 8(*b*) and (*c*), the elastic constant thereof can be decreased. Even in the case where any negative capacitance circuit 8*a*, 8*b* or 8*c* is connected, the elastic constant of the piezoelectric body 9 changes at a frequency in which the electric loss of the piezoelectric body 9 and the negative capacitance circuits 8*a*, 8*b* and 8*c* substantially agree.

An element Z0 as shown in FIG. 8 is formed by a resistor and a condenser. In this case, if a condenser made of the same material as the piezoelectric material is used, it is possible to uniformly change the elastic constant of the piezoelectric body 9 irrespective of the frequency. Elements Z1 and Z2 as shown in FIGS. 8(*a*) through (*c*) are constituted by at least one of a resistor, a condenser and a coil. The capacitance of the negative capacitance circuits 8*a* and 8*b* as shown in FIGS. 8(*a*) and (*b*) is expressed by a product of the capacitance of the element Z0 and the impedance ratio (Z2/Z1) of the elements Z2 and Z1.

In the negative capacitance circuit 8*c* as shown in FIG. 8(*c*), an element expressed by −Z3×Z5/Z4 is connected in parallel with the element Z0. The capacitance of the negative capacitance circuit 8*c* is expressed by a product of the capacitance, in which the element expressed by −Z3×Z5/Z4 is connected in parallel with the element Z0, and the impedance ratio (Z2/Z1). If the elements Z1 and Z2 are constituted by one variable resistor, it is possible to make the capacitance of the negative capacitance circuits 8*a*, 8*b* and 8*c* variable.

Figure 9:
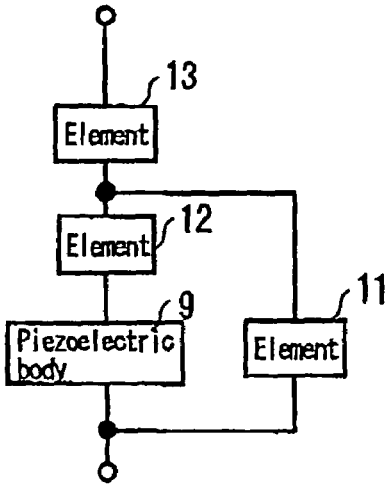
FIG. 9 is a schematic diagram of the piezoelectric body and elements which are connected to a negative capacitance circuit.

As shown in FIG. 9, elements 11, 12 and 13 are connected to the piezoelectric body 9 which is connected to the negative capacitance circuits 8*a*, 8*b* and 8*c*. The elements 11 through 13 can be constituted by at least one of a resistor, a condenser, and a coil, or by opening the element 11, the elements 12 and 13 can also be short-circuited.

Figure 10:
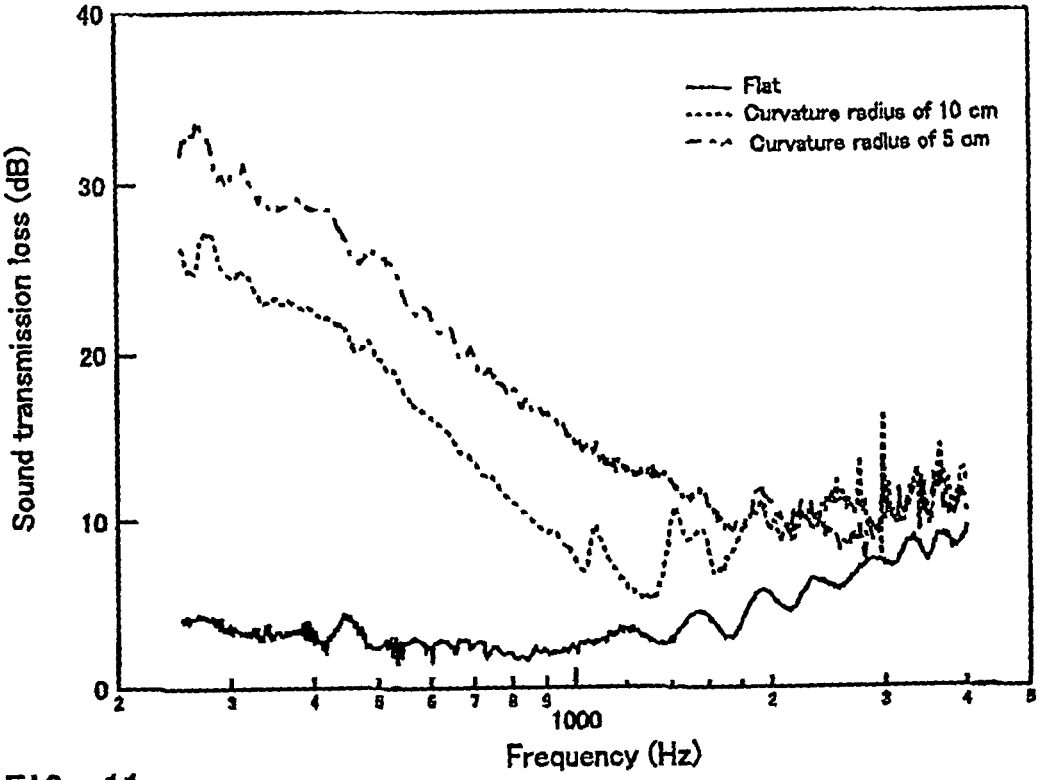
FIG. 10 shows the frequency characteristics of a sound transmission loss of which the parameter is the curvature radius of a polymer film.

An evaluation result of the sound insulation characteristics on the sound insulation/absorption structure according to the present invention is shown in FIG. 10. A vertically incident transmission loss was measured, using a sound tube, for a polymer film having a flat shape and polymer films with a curvature radius of 10 cm or 5 cm, to which a metal mesh is applied from behind.

In the case of the flat polymer film, the sound transmission loss is several dB and the polymer film does not demonstrate a sound insulation performance. However, in the case of the polymer film with a curvature radius of 10 cm, the sound transmission loss increases more than 10~20 dB and shows a tendency to increase in response to the low frequency peculiar to the stiffness control.

As a result of changing the curvature radius of the polymer film from 10 cm to 5 cm, the sound transmission loss further increased by about 5 dB. In this manner, when the curvature is applied to the polymer film, the film begins to show the sound insulation performance of stiffness control and the sound insulation performance increases as the curvature radius becomes smaller.

Figure 11:
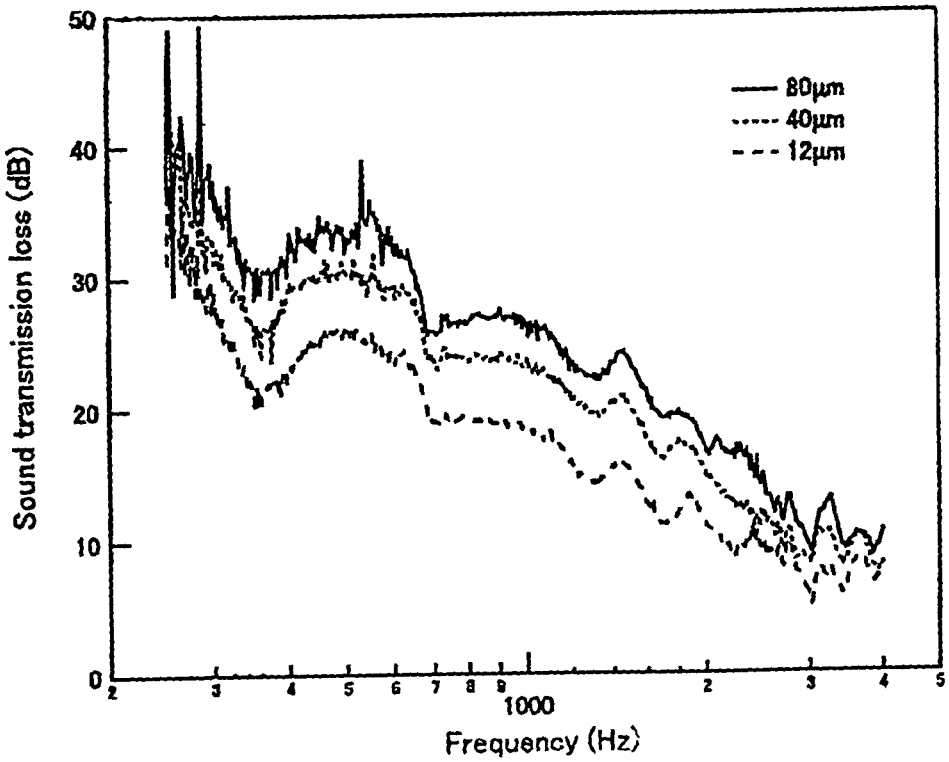
FIG. 11 shows the frequency characteristics of a sound transmission loss of which the parameter is the thickness of the polymer film.

Next, frequency characteristics of the sound transmission loss in a polymer film of a thickness of 12 microns, 40 microns, and 80 microns, which is formed into a dome shape and to which tensile force is applied are shown in FIG. 11. The sound transmission loss increases as the thickness of the polymer film increases.

Next, a polymer film is secured to a frame body in which a square lattice of 2.5 cm×2.5 cm is arranged 10×10 in every direction and a metal mesh formed into a dome shape is pressed into a polymer film surrounded by each lattice to form the polymer film in a dome shape. The domed polymer film is then disposed in a two-dimensional manner to provide a sound insulation/absorption structure. An insertion loss of the sound insulation/absorption structure formed in this manner was measured using a small reverberation box. In addition, an evaluation was also made on the sound insulation/absorption structure to which flat veneer boards with a thickness of 1 cm each are laminated to provide a double wall.

Figure 12:
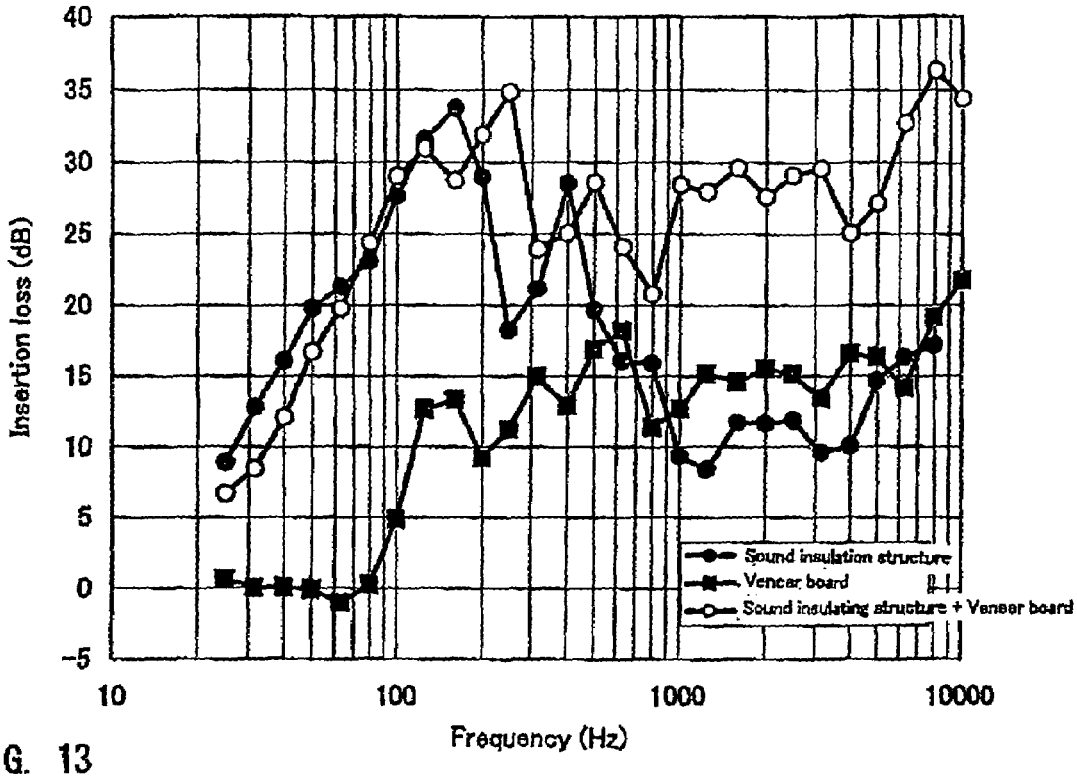
FIG. 12 shows the frequency characteristics of an insertion loss of the sound insulation/absorption structure.

FIG. 12 shows the evaluation result. An insertion loss of the sound insulation/absorption structure according to the present invention shows a tendency to become larger as the frequency peculiar to the stiffness control lowers. On the other hand, the insertion loss of the veneer board shows a tendency to become larger as the frequency peculiar to the mass law becomes higher. In the double wall having these combined, an insertion loss of more than 20 dB was obtained between 100 Hz and 20 kHz.

Figure 13:
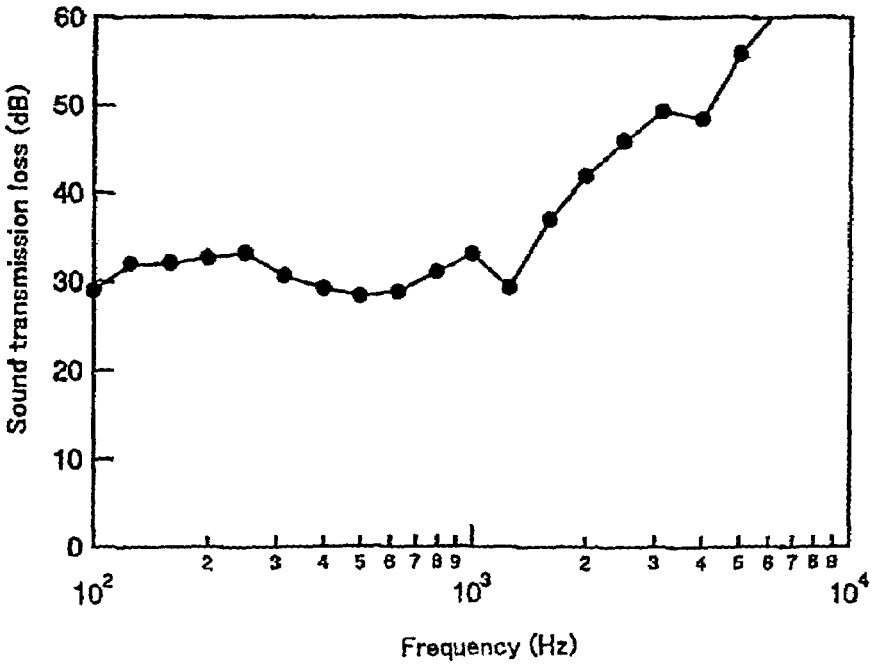
FIG. 13 shows the frequency characteristics of a sound transmission loss of a panel in which a rigid plastic molded into a dome shape is used.

FIG. 13 is a graph showing the sound insulation performance of a panel using a rigid plastic formed into a dome shape, relative to the frequency. A rectangular opening of 14 cm×24 cm is provided at the center of a rectangular aluminum plate (1 cm thick) of 20 cm×30 cm and a polyethylene terephthalate (PET) plate with a thickness of 1.5 mm formed into a dome shape with a height of 3 cm is inserted into the opening. The periphery of the plate is held and secured between two aluminum frames from both directions.

In the case of more than 1 kHz, the sound insulation performance improves as the frequency becomes higher. In other words, a tendency of sound insulation by a so-called mass of plate can be seen. On the other hand, in the case of less than 1 kHz, a tendency of frequency dependence can not be seen in the sound insulation performance and a result whereby the sound insulation performance becomes constant at about 30 dB was obtained. This is because the sound insulation acts from elasticity of the plastic plate formed into a dome shape.

Figure 14:
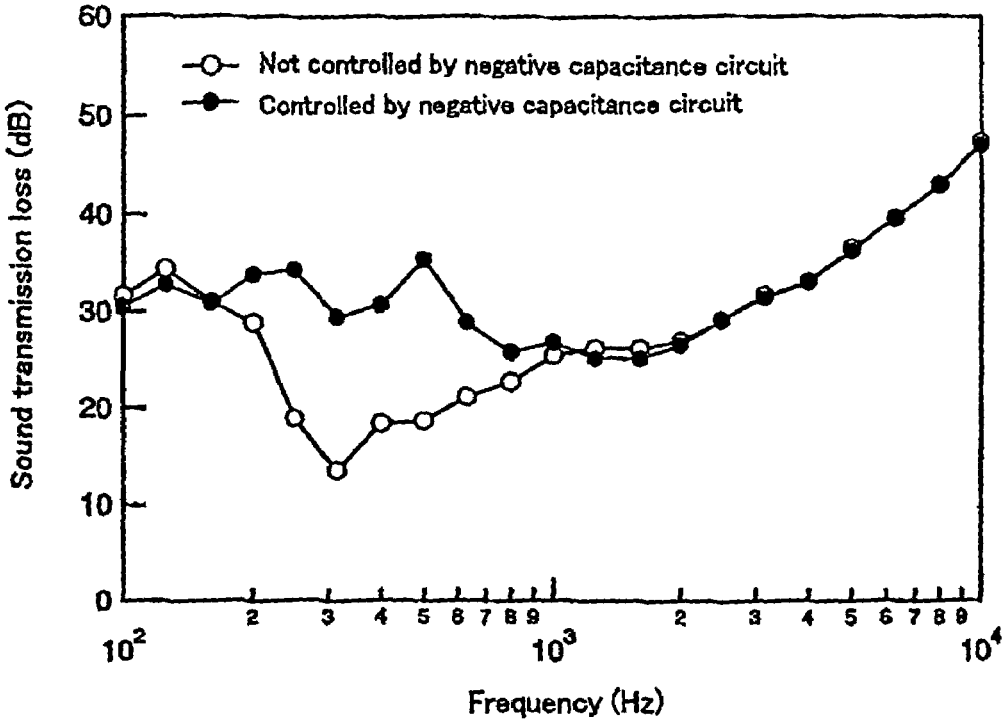
FIG. 14 shows the frequency characteristics of a sound transmission loss in the case where a PVDF film is controlled by a negative capacitance circuit.

FIG. 14 shows the result of sound insulation performance control in which the plastic plate of the panel is PVDF (polyvinylidene fluoride) film and is controlled by the negative capacitance circuit. Since the elastic force of the film is small as compared to the rigid plastic, the resonance frequency of the in-plane stretching vibration moves to the lower frequency side. The film's original sound insulation performance shows the effect by the mass in the case of more than 300 Hz. In the case of less than 300 Hz, there is a tendency for the sound insulation performance to increase in response to the low frequency peculiar to the elastic effect. The sound insulation performance of the panel increased up to 20 dB between 100 Hz and 1 kHz by the circuit control.

Figure 15:
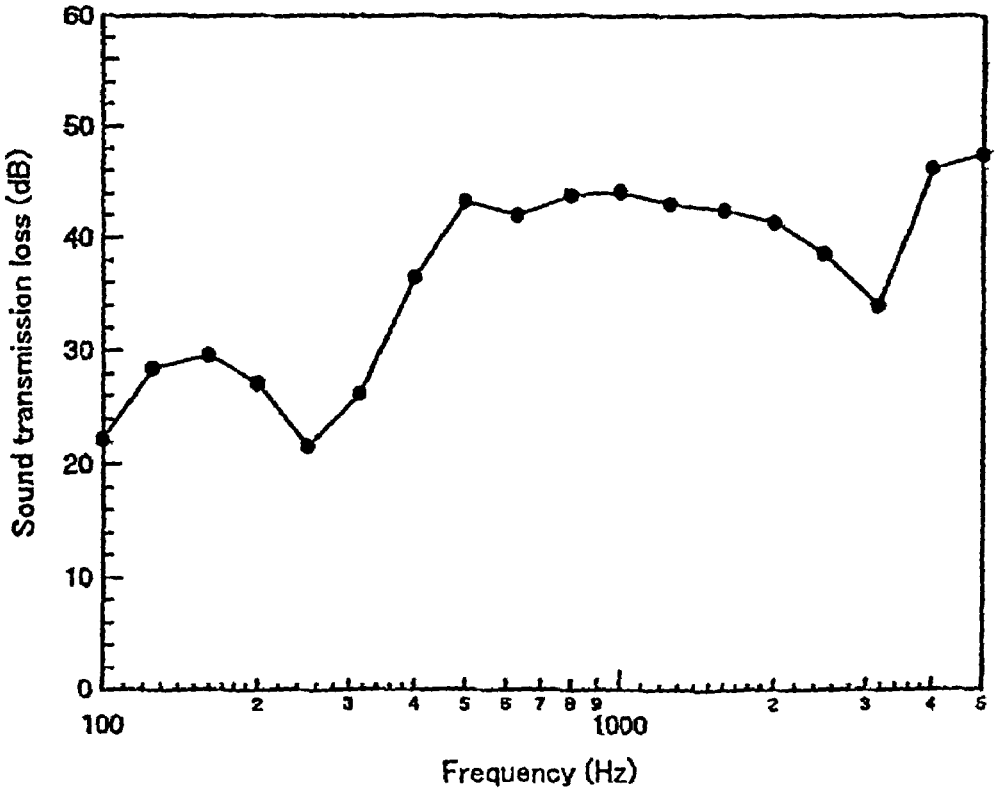
FIG. 15 shows the frequency characteristics of a sound transmission loss of a large panel in which a rigid plastic of a dome shape is set in a two-dimensional array.
Figure 16:
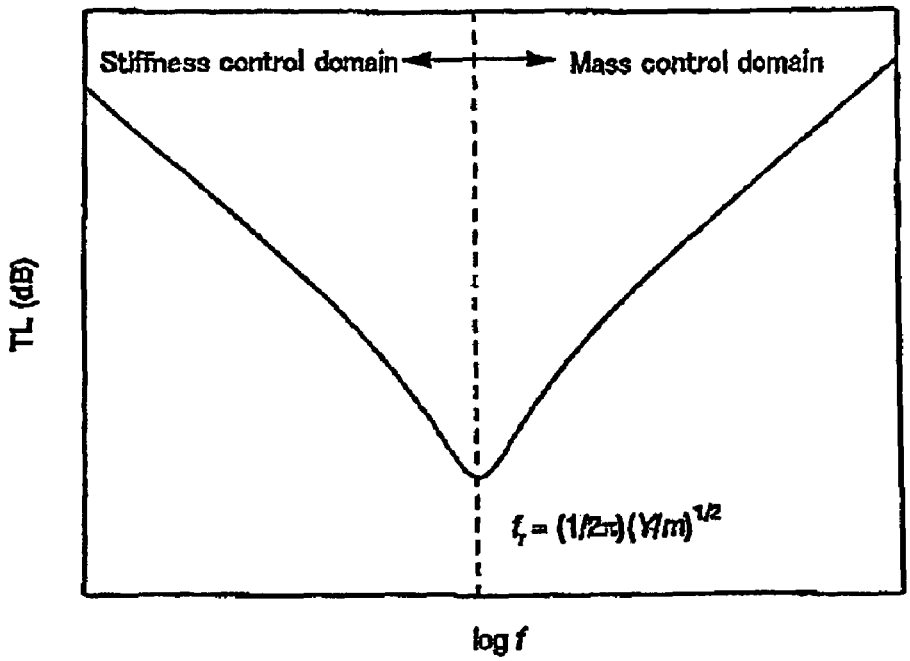
FIG. 16 is a graph showing the sound transmission loss relative to a logarithmic frequency.

FIG. 15 shows frequency characteristics of the sound insulation performance of a large panel in which a dome-shaped rigid plastic is disposed in a two-dimensional manner. The outer peripheral dimensions of the panel are about 1.2 m×1.6 m. A PET plate with a thickness of 1.5 mm formed into a square of 4 cm×4 cm and a dome shape of a curvature radius of 4 cm was arranged on the panel in a two-dimensional manner. The dome shape was disposed at 15 locations to be 5 lines×3 rows on the PET plate of a size of 20 cm×30 cm and each dome shape is secured by an aluminum frame. This is one unit, and 30 additional units of the dome shapes were further disposed to have 6 lines×5 rows. The large panel demonstrated a sound insulation performance of more than 20 dB was maintained between 100 HZ and 1 kHz.

These results indicate that the present invention can provide a sound insulation structure which realizes sound insulation by the elastic force of the domed film or plate from a small structure to a large-sized sound insulation wall.

INDUSTRIAL APPLICABILITY

According to the present invention, a light film member, and a frame body having at least one opening of a lattice, honeycomb or annular shape are provided, the periphery of the film member is secured by the frame body, and the section of the film member surrounded by the frame body is formed into a curved shape such as a dome and a barrel, wherein the resonance frequency of the section in the in-plane stretching vibration is set at a frequency equal to or higher than the audible frequency band, thereby being capable of insulating or absorbing sound by stiffness control.

Further, an elastic body and a film member are put on a supporting plate to be pressed with a frame body so that the elastic body and the film member are held between the frame body and the supporting plate to apply a tensile force to the film member, wherein the film member is formed into a curved shape such as dome, and the resonance frequency of this curved shape in the in-plane stretching is set at a frequency equal to or higher than the audible frequency band, thereby being capable of insulating or absorbing sound by stiffness control.

Still further, the film member or the plate member constituting the sound control.

Still further, the film member or the plate member constituting the sound insulation/absorption structure is provided with a piezoelectric member and a circuit presenting a negative capacitance is connected to the piezoelectric member. Further, the film member or the plate member constituting the sound insulation/absorption structure can be a member with piezoelectric properties. By connecting the circuit presenting the negative capacitance to this member, it is possible to provide a sound insulation/absorption device which can electrically control the sound insulation/absorption performance.

The sound insulation/absorption structure and the sound insulation/absorption device can be applied to all structures which require sound insulation/absorption and to a member constituting the structures, such as an automobile, a vehicle such as an electric train, an aircraft, a marine vessel and other transport equipment (vehicle), a panel, a partition and other building materials, a sound insulation wall, a sound-proof wall, a building structure, a chamber, electric equipment, a machine, acoustic equipment and the like.

Although there have been described what are the present exemplary embodiments of the invention, it will be understood that variations and modifications may be made thereto within the spirit and scope of the appended claims.

What is claimed is:

1. A sound insulation/absorption structure having a film member formed of at least one of polymer and metal, wherein the film member is formed into a curved shape such as a dome, a barrel, and a cone, a periphery of this curved shape is fixed to another structure, and a resonance frequency of the curved shape in in-plane stretching is set at a frequency equal to or higher than an audible frequency band to insulate or absorb sound by elastic force of the film member.

2. The sound insulation/absorption structure according to claim 1, further comprising a holding means to hold the film member in the curved shape.

3. The sound insulation/absorption structure according to claim 1, wherein a tensile force is applied to the film member.

4. The sound insulation/absorption structure according to claim 1, wherein the film member is replaced by a plate member, such as a plastic plate, a metal plate, and a veneer plate, molded into the curved shape such as a dome, a barrel, and a cone.

5. The sound insulation/absorption structure according to claim 1, wherein the film member formed into a curved shape is set in a one-dimensional or two-dimensional array.

6. The sound insulation/absorption structure according to claim 1, wherein surface density, elastic constant, outer peripheral dimensions, and curvature radius of a curved section of the film member are set so that the resonance frequency of the curved shape in the in-plane stretching vibration is within or higher than the audible frequency band.

7. A sound insulation/absorption device comprising the sound insulation/absorption structure according to claim 1, a piezoelectric member provided with the film member, and a circuit presenting a negative capacitance connected to the piezoelectric member.

8. A structure having the sound insulation/absorption device according to claim 7 applied thereto, wherein the sound insulation/absorption device is applied to the structure such as an automobile, a vehicle such as an electric train, an aircraft, a marine vessel and other transport equipment (vehicle), a panel, a partition and other building material, a sound insulation wall, a sound-proof wall, a building structure, a chamber, electric equipment, a machine, and acoustic equipment to insulate or absorb sound.

9. The sound insulation/absorption device comprising the sound insulation/absorption structure according to claim 1, wherein the film member thereof has piezoelectric characteristics, and a circuit presenting a negative capacitance is connected to the film member.

10. A member constituting the structure having the sound insulation/absorption device according to claim 9 applied thereto, wherein the sound insulation/absorption device is applied to the member constituting the structure such as an automobile, a vehicle such as an electric train, an aircraft, a marine vessel and other transport equipment (vehicle), a panel, a partition and other building material, a sound insulation wall, a sound-proof wall, a building structure, a chamber, electric equipment, a machine, and acoustic equipment to insulate or absorb sound.

11. A structure having the sound insulation/absorption structure according to claim 1 applied thereto, wherein the sound insulation/absorption structure is applied to structures such as an automobile, a vehicle such as an electric train, an aircraft, a marine vessel and other transport equipment (vehicle), a panel, a partition and other building material, a sound insulation wall, a sound-proof wall, a building structure, a chamber, electric equipment, a machine, and acoustic equipment to insulate or absorb sound.

12. A sound insulation/absorption structure comprising a film member formed of at least one of polymer and metal, and a frame body having at least one opening of a lattice, honeycomb or annular shape, wherein the film member is fixed to the frame body, a section of the film member surrounded by the frame body is formed into a curved shape such as a dome, a barrel, and a cone, and a resonance frequency of the curved shape in in-plane stretching is set at a frequency equal to or higher than an audible frequency band to insulate or absorb sound by elastic force of the film member.

13. The sound insulation/absorption structure according to claim 12, wherein the film member and the frame body are integrally formed.

14. A member constituting the structure having the sound insulation/absorption structure according to claim 12 applied thereto, wherein the sound insulation/absorption structure is applied to a member constituting the structure such as an automobile, a vehicle such as an electric train, an aircraft, a marine vessel and other transport equipment (vehicle), a panel, a partition and other building material, a sound insulation wall, a sound-proof wall, a building structure, a chamber, electric equipment, a machine, and acoustic equipment to insulate or absorb sound.

15. The sound insulation/absorption structure according to claim 12, further comprising a holder to hold the film member in the curved shape.

16. The sound insulation/absorption structure according to claim 12, wherein a tensile force is applied to the film member.

17. The sound insulation/absorption structure according to claim 12, wherein the film member formed into a curved shape is set in a one-dimensional or two-dimensional array.

18. The sound insulation/absorption structure according to claim 12, wherein surface density, elastic constant, outer peripheral dimensions, and curvature radius of a curved section of the film member are set so that the resonance frequency of the curved shape in the in-plane stretching vibration is within or higher than the audible frequency band.

19. A sound insulation/absorption structure comprising a film member, a frame body, an elastic body, and a supporting plate, wherein the elastic body and the film member are disposed on the supporting plate to be pressed with the frame body so that the elastic body and the film member are held between the frame body and the supporting plate to apply a tensile force to the film member, the film member is formed into a curved shape such as a dome, and a resonance frequency of the curved shape in in-plane stretching is set at a frequency equal to or higher than an audible frequency band to insulate or absorb sound by elastic force of the film member.

20. A sound insulation/absorption structure comprising two film members, a frame body, and an elastic body, wherein the elastic body is placed between the two film members, the elastic body and the two film members are held between the frame body to apply a tensile force to the two film members, the two film members are respectively formed into a curved shape, and a resonance frequency of the curved shape in in-plane stretching is set at a frequency equal to or higher than an audible frequency band to insulate or absorb sound by elastic force of the film.

* * * * *

UNITED STATES PATENT AND TRADEMARK OFFICE

CERTIFICATE OF CORRECTION

PATENT NO. : 7,464,790 B2
APPLICATION NO. : 10/562924
DATED : December 16, 2008
INVENTOR(S) : Kodama et al.

Column 1:
Line 44, change “relative the” to --relative to the--.

Column 2:
Line 1, change “at most even by” to --at most, even by--.
Lines 13-14, delete “in collective housing or transport facilities because the sound insulation performance depends”.

Column 3:
Line 18, change “It is therefore an object” to --It is, therefore, an object--.
Line 39, change “frame body, the section” to --frame body. The section--.

Column 4:
Line 38, change “curvature-having shape” to --curved shape--.
Line 47, change “members, the two” to --members. The two--.
Line 61, change “according to according to” to --according to--.

Column 5:
Line 1, change “a one or two-dimensional” to --a one- or two-dimensional--.
Line 5, change “according to according to an ninth” to --according to a ninth--.
Line 13, change “according to according to an tenth” to --according to a tenth--.
Line 29, change “an twelfth aspect” to --a twelfth aspect--.
Line 40, change “an thirteenth aspect” to --a thirteenth aspect--.
Line 50, change “an fourteenth aspect” to --a fourteenth aspect--.
Line 59, change “an fifteenth aspect” to --a fifteenth aspect--.

UNITED STATES PATENT AND TRADEMARK OFFICE

CERTIFICATE OF CORRECTION

PATENT NO. : 7,464,790 B2
APPLICATION NO. : 10/562924
DATED : December 16, 2008
INVENTOR(S) : Kodama et al.

It is certified that error appears in the above-identified patent and that said Letters Patent is hereby corrected as shown below:

Column 6:
Line 1, change "an sixteenth aspect" to --a sixteenth aspect--.
Line 12, change "BRIEF DESCRIPTION THE DRAWINGS" to --BRIEF DESCRIPTION OF THE DRAWINGS--.

Column 9:
Line 16, change "It is therefore important" to --It is, therefore, important--.

Column 11:
Line 34, change "between 100HZ and 1kHz." to --between 100Hz and 1kHz.--.

Signed and Sealed this

Nineteenth Day of May, 2009

John Doll

JOHN DOLL
*Acting Director of the United States Patent and Trademark Office*